US007977894B1

(12) United States Patent
Xiong et al.

(10) Patent No.: US 7,977,894 B1
(45) Date of Patent: Jul. 12, 2011

(54) PROGRAMMED START BALLAST FOR GAS DISCHARGE LAMPS

(75) Inventors: Wei Xiong, Madison, AL (US); Christopher Radzinski, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 361 days.

(21) Appl. No.: 12/349,371

(22) Filed: Jan. 6, 2009

Related U.S. Application Data

(60) Provisional application No. 61/036,277, filed on Mar. 13, 2008.

(51) Int. Cl.
*G05F 1/00* (2006.01)

(52) U.S. Cl. ..... 315/310; 315/48; 315/107; 315/126; 315/119

(58) Field of Classification Search ..... 315/46–50, 315/73–75, 94–107, 114–128, 291, 307–311
See application file for complete search history.

(56) References Cited

U.S. PATENT DOCUMENTS 4,686,427 A 8/1987 Burke
5,424,611 A 6/1995 Moriarty, Jr.
5,841,239 A 11/1998 Sullivan
5,877,592 A 3/1999 Hesterman et al.
5,945,788 A 8/1999 Li et al.
5,959,408 A 9/1999 Steel et al.
6,043,611 A 3/2000 Gradzki
6,448,713 B1 9/2002 Farkas et al.
6,501,225 B1 12/2002 Konopka
6,603,274 B2 8/2003 Ribarich
6,686,705 B2 2/2004 Nerone
6,873,121 B1 3/2005 Stevens
7,154,229 B2 12/2006 Alexandrov et al.
7,187,132 B2 3/2007 Bakre
7,247,991 B2 7/2007 Chen
2007/0138967 A1 6/2007 Chen et al.
2008/0054825 A1 3/2008 Gulsen et al.
2008/0218101 A1 * 9/2008 Vaziri ..... 315/307

FOREIGN PATENT DOCUMENTS

CN ZL 01125092.5 7/2006

* cited by examiner

*Primary Examiner* — Tuyet Thi Vo

(74) *Attorney, Agent, or Firm* — Waddey & Patterson; Mark J. Patterson

(57) ABSTRACT

An electronic ballast has control circuitry to provide a pre-heating signal to the filaments of a gas discharge lamp for a predetermined length of time before the lamp is ignited and, further, cease providing the pre-heating signal after the lamp has been ignited.

20 Claims, 4 Drawing Sheets

PROGRAMMED START BALLAST FOR GAS DISCHARGE LAMPS

CROSS-REFERENCE TO RELATED APPLICATIONS

This application is a non-provisional application which claims benefit of co-pending U.S. Patent Application Ser. No. 61/036,277 filed Mar. 13, 2008, entitled "Novel Program Start Dimming Ballast for Independent Parallel Lamp Operation" which is hereby incorporated by reference.

BACKGROUND OF THE INVENTION

The present invention relates generally to electronic ballasts for gas discharge lamps. More particularly, the present invention pertains to electronic ballasts capable of providing a programmed start to pre-heat the filaments of a gas discharge lamp prior to striking/igniting the lamp.

Conventionally, there have been several types of electronic ballasts employed to operate gas discharge lamps—including, instant start and rapid start ballasts. The type of ballast selected often depends on the environment in which the lamp/ballast will be used. For example, when it is desired to turn the lamp on with minimal delay, instant start ballasts are typically used. Instant start ballasts ignite or strike a lamp by applying a high voltage signal across the lamp to cause an arc to form between the filaments, which allow the ballast to illuminate the lamp without any other pre-striking measures.

In some circumstances, e.g. for safety considerations, it is desirable to ignite a lamp utilizing a minimized striking potential/voltage signal. Rapid start ballasts satisfy this end. Rapid start ballasts concurrently provide both a filament heating voltage signal to heat the filaments and a lamp voltage signal across the lamp. As the filaments warm, via the filament heating signal, the magnitude of the voltage signal (across the lamp) required to ignite the lamp is reduced. Eventually, as a result of filament pre-heating, the lamp voltage signal supplied by the rapid start ballast will be sufficient to ignite the lamp at the reduced magnitude.

One significant concern with gas discharge lamps used in frequent-start applications is lamp life. One cause of reduced lamp life is premature deterioration of the emissive material coating the filaments (the emissive material is crucial for proper lamp operation). Among others, premature deterioration of the emissive material is caused by igniting lamps with filaments that have not been pre-heated (e.g. the case with instant start ballasts) or applying a voltage across the lamp as the filaments are being pre-heated (e.g. the case with rapid start ballasts). Convention wisdom has advocated the use of rapid start ballasts in frequent-start applications, as the extent of premature emissive material deterioration caused by rapid start ballasts is less than that caused by instant start ballasts.

Unfortunately, rapid start ballasts have an additional drawback; they are less efficient than instant start ballasts. These inefficiencies can be attributed, in part, to the fact that rapid start ballasts continue to supply a filament heating signal to the filaments even after the lamp has been ignited. After the lamp has been ignited, generally, additional filament heating is not necessary and the power consumed by continuously providing the filament heating signal results in operational inefficiencies.

Programmed start ballasts have been used to solve this vexing problem. A programmed start ballast functions by first providing a filament pre-heating signal to the filaments to increase the temperature of the filaments. After the filaments are heated to a desired level, the ballast then strikes the lamps.

Subsequent the striking process, the programmed start ballast eliminates the filament heating signal. Accordingly, programmed start ballasts minimize premature deterioration of the emissive material by pre-heating the filaments while operating the lamp in an efficient manner (i.e. eliminating the filament pre-heating signal after the lamp has been struck).

One common method used by programmed start ballasts involves manipulating the frequency of the power signal used to drive the lamp. Specifically, during the filament pre-heating stage the lamp power signal is generated at a frequency removed from the resonant frequency of the resonant driving circuit to reduce the lamp power signal to a level suited for filament pre-heating. After the filaments reach the desired temperature, the frequency of the lamp power signal is swept toward the resonant frequency of the driving circuit to provide a voltage signal capable of igniting the lamp.

Unfortunately, the control circuitry required to implement this type of sweep frequency ballast can be complex and costly. Thus, what is needed is an electronic ballast that can provide a filament pre-heating signal to bring the filaments to a desired temperature before attempting to strike the lamp. It is further desirable to have an electronic ballast that can stop providing the filament heating signal after the lamp has been struck—all in a simple, reliable, and cost-effective package.

BRIEF SUMMARY OF THE INVENTION

The present invention relates to an electronic ballast capable of providing a filament pre-heating signal to heat the filaments of a lamp to a desired temperature prior to striking the lamp and, further, staying the supply of the filament pre-heating signal after the lamp has been struck to maintain efficient lamp operation.

The ballast of the present invention includes a power converter circuit to accept a DC input supply signal and generate an AC output signal suitable to operate the lamp(s). To accomplish this task, the power converter circuit uses, in part, a resonant output transformer to supply an output transformer signal to drive the lamps. The power converter circuit also includes a pre-heating transformer to heat the filaments to a desired temperature before the lamps are struck. Specifically, the pre-heating transformer has a primary winding with a first end coupled to a first shunt terminal and a second end coupled to a second shunt terminal and a secondary winding capable of coupling to the lamp.

The present invention also includes a timing circuit and a shunt circuit, collectively referred to as a bypass circuit. The timing circuit is coupled to the resonant output transformer to receive the transformer output signal. The timing circuit provides a timing circuit signal after a delay period. The delay period controls the length of time the pre-heating signal is supplied to the filaments which, in effect, controls the temperature of the filaments prior to striking the lamp. The delay period is responsive to changes in the transformer output signal. Thus, according to one particular embodiment of the present invention, the transformer output signal may start the running of the delay period (i.e. the presence of the transformer output signal may trigger the delay period) and/or set the length of the delay period.

The shunt circuit is coupled to the timing circuit to receive the timing circuit signal (after the delay period has ended). The shunt circuit is also coupled between the first and second shunt locations. When the timing circuit signal is present, the shunt circuit is capable of reducing the electrical impedance between the first and second shunt terminals. For example, the reduction of electrical impedance may be affected by creating a low resistance path between the first and second shunt terminals (e.g. a short circuit). As the first and second shunt terminals are coupled to either side of the primary winding of the pre-heating transformer, the shunt circuit may create a low impedance path (e.g. a short circuit) around the primary winding.

Now that the structure of the present invention has been explained, an examination of its operation is in order. After the power to the electronic ballast of the present invention has been turned on, current will flow through the resonant output transformer and the pre-heating transformer. As such, the pre-heating transformer will supply the pre-heating signal to the filaments and the transformer output signal will be provided to the timing circuit. The receipt of the transformer output signal by the timing circuit starts the running of the delay period—note that the timing circuit signal will not be generated until the delay period is over. Thus, during the delay period, the current that passes through the pre-heating transformer will result in filament heating, via the secondary winding of the pre-heating transformer.

After some predetermined amount of time, the delay period will end. This permits the timing circuit to provide the timing circuit signal to the shunt circuit. Once the shunt circuit receives the timing circuit signal, it reduces the electrical impedance between the first and second shunt terminals. As discussed above, the reduction in electrical impedance between the first and second shunt terminals can be accomplished by creating a low impedance path between the terminals, such as a short circuit. The low impedance path causes current to bypass the primary winding of the pre-heating transformer (as the shunt circuit is coupled to either side of the primary winding). With current no longer flowing through the primary windings, filament heating will cease and the ballast of the present invention will attempt to strike the lamp. Thus, the present invention provides an electronic ballast that minimizes premature deterioration of the emissive material, via pre-heating, and still operates the lamp in an efficient manner, via cessation of the filament heating signal during normal lamp operation. Further, this is accomplished in a simple, reliable, and cost-effective manner.

DETAILED DESCRIPTION OF THE INVENTION

Figure 1:
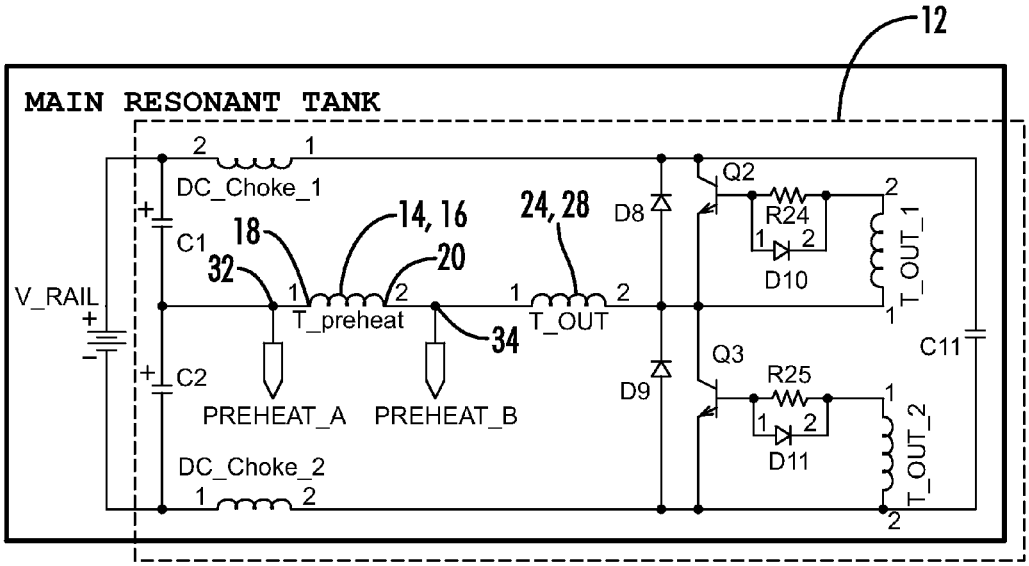
FIG. 1 is a schematic of one embodiment of a power converter circuit in accordance with the present invention.
Figure 2:
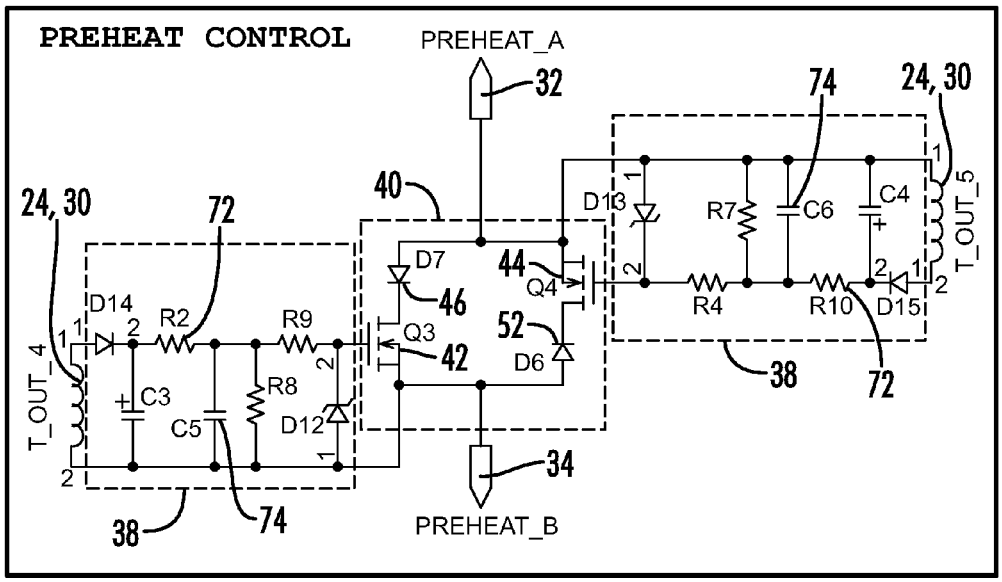
FIG. 2 is a schematic of one embodiment of a bypass circuit used in the present invention.

The present invention relates generally to an electronic ballast having control circuitry for pre-heating gas discharge lamp filaments prior to striking the lamp(s). FIG. 1 illustrates one embodiment of a power converter circuit 12. The power converter circuit 12 may also be described as an inverter 12. The power converter circuit 12 functions to convert a direct current signal; for example, supplied from a power factor correcting circuit, to an alternating current signal suitable to drive the lamp(s).

Figure 4:
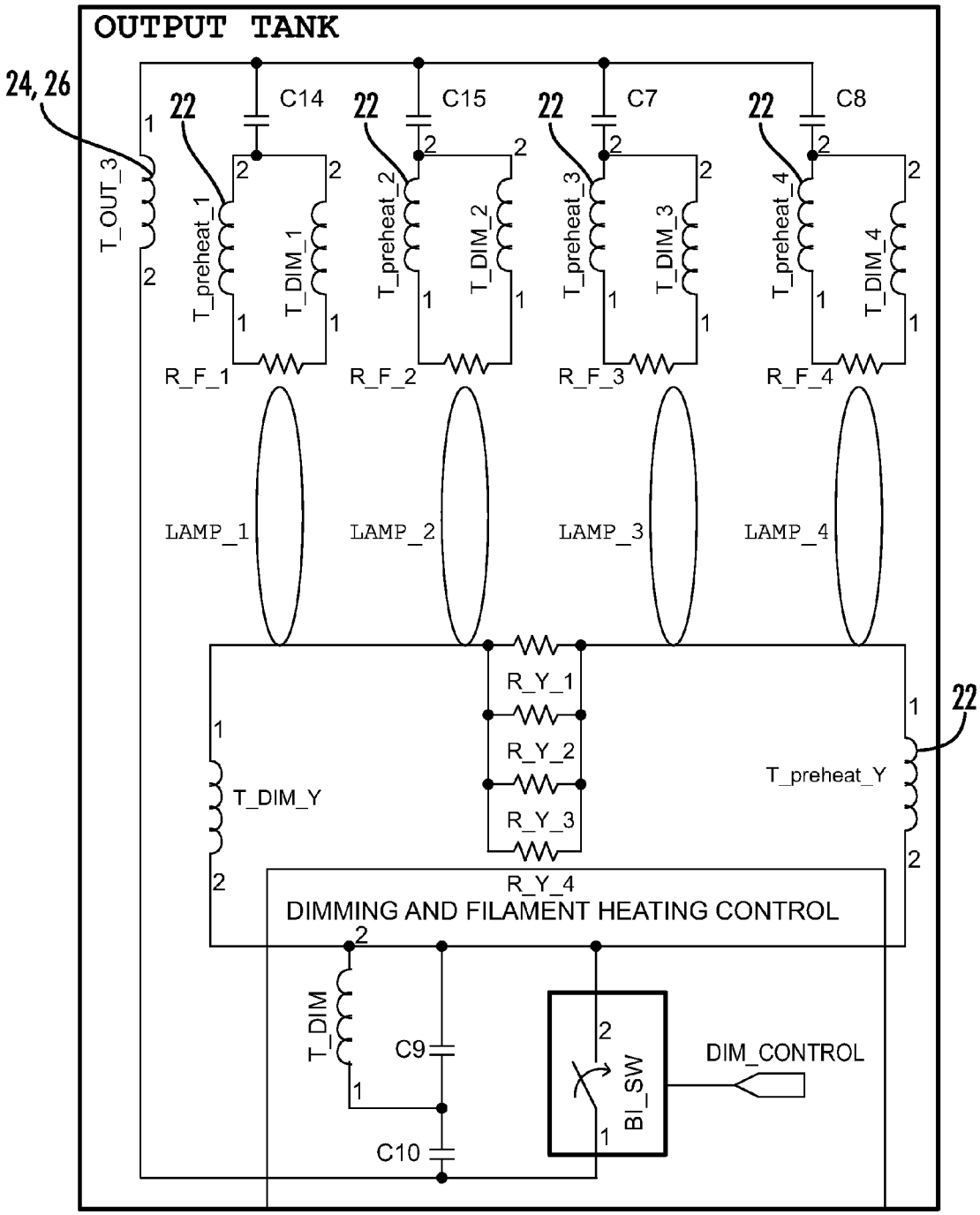
FIG. 4 is a schematic view of one embodiment of the secondary windings of the pre-heating transformer as used in one embodiment of the present invention.

The power converter circuit 12 includes a pre-heating transformer 14 or pre-heating circuit 14 having a primary winding 16 and a secondary winding 22 (FIG. 4). The primary winding 16 has first and second ends 18 and 20. The secondary winding 22 is adapted to couple to the filaments of a lamp after the lamp has been connected to the ballast. Thus, if one lamp is used, the secondary winding 22 may include two winding elements, one for each of the lamp's filaments. Further, if multiple lamps are used, specifically in a parallel configuration, then the secondary winding 22 may have more than two winding elements, as shown in FIG. 4.

The power converter circuit 12 also has a resonant output transformer 24 used to generate an output transformer signal to drive the lamp(s). Specifically, the output transformer signal is delivered across the lamp by a secondary winding 26 (FIG. 4) of the resonant output transformer 24. In one embodiment, the primary winding 28 of the resonant output transformer 24 is coupled to the primary winding 16 of the pre-heating transformer 14. The power converter circuit 12 further includes a first shunt terminal 32 coupled to the first end 18 of the primary winding 16 and a second shunt terminal 34 coupled to the second end 20 the primary winding 16*f* the pre-heating transformer 14. Although the first and second shunt terminals 32 and 34 may embody distinct, physical components, they may also simply describe connecting nodes on an electrical circuit. Further, in one embodiment, the first shunt terminal 32 has the same potential as the first end 18 of the primary winding 16 and the second shunt terminal 34 has the same potential as the second end 20 of the primary winding 16. Moreover, an electrical impedance is defined between the first and second shunt terminals 32 and 34 or, equivalently in the embodiment described immediately above, across the primary winding 16 of the pre-heating transformer 14.

The present invention also includes a timing circuit 38 and a shunt circuit 40 (also referred to as a bypass switch 40). In some embodiments, the timing circuit 38 and the shunt circuit 40 are collectively referred to as a bypass circuit. The timing circuit 38 is employed to determine when the filaments are sufficiently pre-heated, i.e. attain the desired temperature, and to generate a timing circuit signal, after pre-heating, to indicate that attempts to strike the lamp may be commenced. To this end the timing circuit 38 has a delay period which defines the length of time the filaments are heated prior to initiating lamp striking efforts. In one embodiment, the timing circuit 38 is coupled to the resonant output transformer 24 (particularly, the delay winding 30 of the resonant output transformer 24 which is another secondary winding) to receive the output transformer signal, which serves as a trigger for the running of the delay period. In other embodiments, the output transformer signal not only serves as a trigger to the delay period but also determines, at least in part, the length of the delay period—variance of the signal characteristics of the output transformer signal (e.g. magnitude) may affect the length of the delay period.

The timing circuit 38 may also include a resistor 72 or timing resistor 72 and a capacitor 74 or timing capacitor 74. The capacitor 74 is charged via the output transformer signal. The RC time constant associated with the component values of the resistor 72 and capacitor 74 (e.g. 1 k ohms, 4 μF, etc.) define, in part, the delay period. Thus, not only can the delay period be affected by variances in the output transformer signal but also by different component values or arrangements of the resistor 72 and the capacitor 74.

The shunt circuit 40 is coupled between the first and second shunt terminals 32 and 34. In one embodiment, functionally, the shunt circuit 40 is in parallel electrical connection with the primary winding 16 of the pre-heating transformer 14. The shunt circuit 40 is also coupled to the timing circuit 38 to receive the timing circuit signal. In operation, when the shunt circuit 40 receives the timing circuit signal, the shunt circuit 40 reduces the electrical impedance between the first and second shunt terminals 32 and 34. In one embodiment, the reduction in impedance occurs because the shunt circuit 40 creates a virtual short circuit (a low impedance bi-directional path) between the first and second shunt terminals 32 and 34. Alternatively worded, the shunt circuit 40 creates an electrical shunt around the primary winding of the pre-heating transformer 16. Assuming the timing circuit signal is present, most or all of the current passing between the first and second shunt terminals 32 and 34 will take the path created by the shunt circuit 40. Therefore, little or no current will pass through the primary winding 16 of the pre-heating transformer 14 and, accordingly, the filaments will not be heated by the secondary winding(s) 22.

Figure 5:
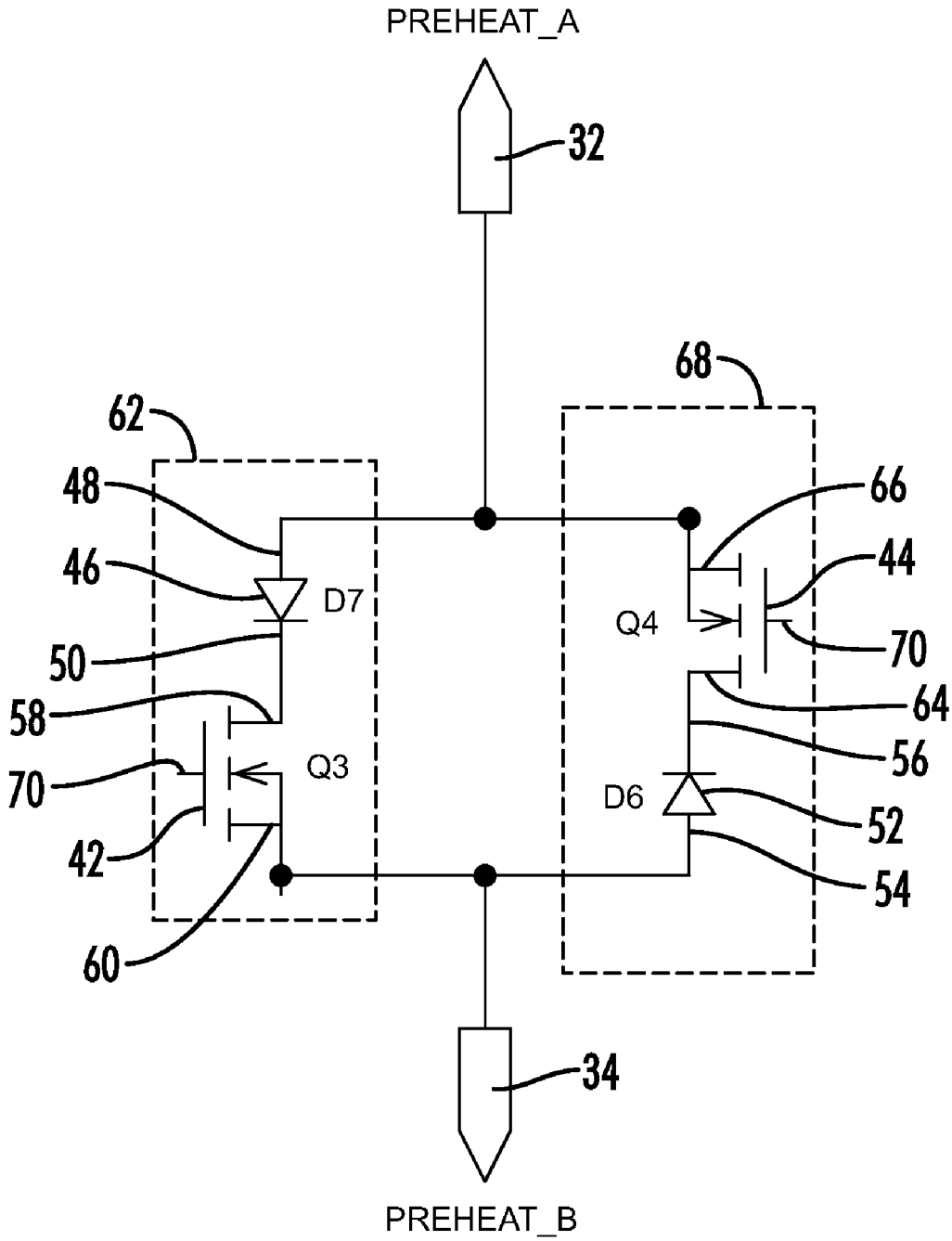
FIG. 5 is a detail view of the shunt circuit.

In one embodiment, the shunt circuit 40 comprises a first shunt switch 42 and a second shunt switch 44, each positioned between the first and second shunt terminals 32 and 34. The first and second shunt switches 42 and 44 may be transistors 42 and 44, such as MOSFETs. Further, the shunt circuit 40 may also include a first diode 46 and a second diode 52. Referring to the specific embodiment depicted in FIG. 5, the anode of the first diode 48 (first anode 48) is coupled to the first shunt terminal 32 (or the first end 18 of the primary winding 16), the cathode of the first diode 50 (first cathode 50) is coupled to the drain of the first transistor 58 (or second terminal of the first transistor 58), and the source of the first transistor 60 (or first terminal of the first transistor 60) is coupled to the second shunt terminal 34 (or second end 20 of the primary winding 16). The first transistor 42 and the first diode 46 define a first switching circuit 62.

The anode of the second diode 54 (second anode 54) is coupled to the second shunt terminal 34 (or the second end 20 of the primary winding 16), the cathode of the second diode 56 (second cathode 56) is coupled to the drain of the second transistor 64 (or second terminal of the second transistor 64), and the source of the second transistor 66 (or first terminal of the second transistor 66) is coupled to the first shunt terminal 32 (or first end 18 of the primary winding 16). The second transistor 44 and the second diode 52 define a second switching circuit 68.

Moreover, both the first and second transistors 42 and 44 (or more generally, the first and second shunt switches 42 and 44) have gates 70, also referred to as switch activation terminals 70 or switch control terminals 70, coupled to the timing circuit 38 to receive the timing circuit signal. As such, when the timing circuit signal is present, the first and second transistors 42 and 44 will be adequately biased and start conducting (causing the first and second diodes 46 and 52 to be forward biased). This creates a virtual short-circuit between the first and second shunt terminals 32 and 34.

When the electronic ballast of the present invention has just been activated, i.e. turned on, current will be delivered to the resonant output transformer 24 and the pre-heating transformer 14; specifically to the primary windings 28 and 16 of the resonant output transformer and pre-heating transformer respectively. As the timing circuit 38 is coupled to the resonant output transformer 24, via the delay winding 30, and the delay period is responsive to the output transformer signal, the delay period will begin to run. Specifically, the output transformer signal will affect, among others, the timing capacitor 74 and timing resistor 72—which help to determine the length of the delay period.

Figure 3:
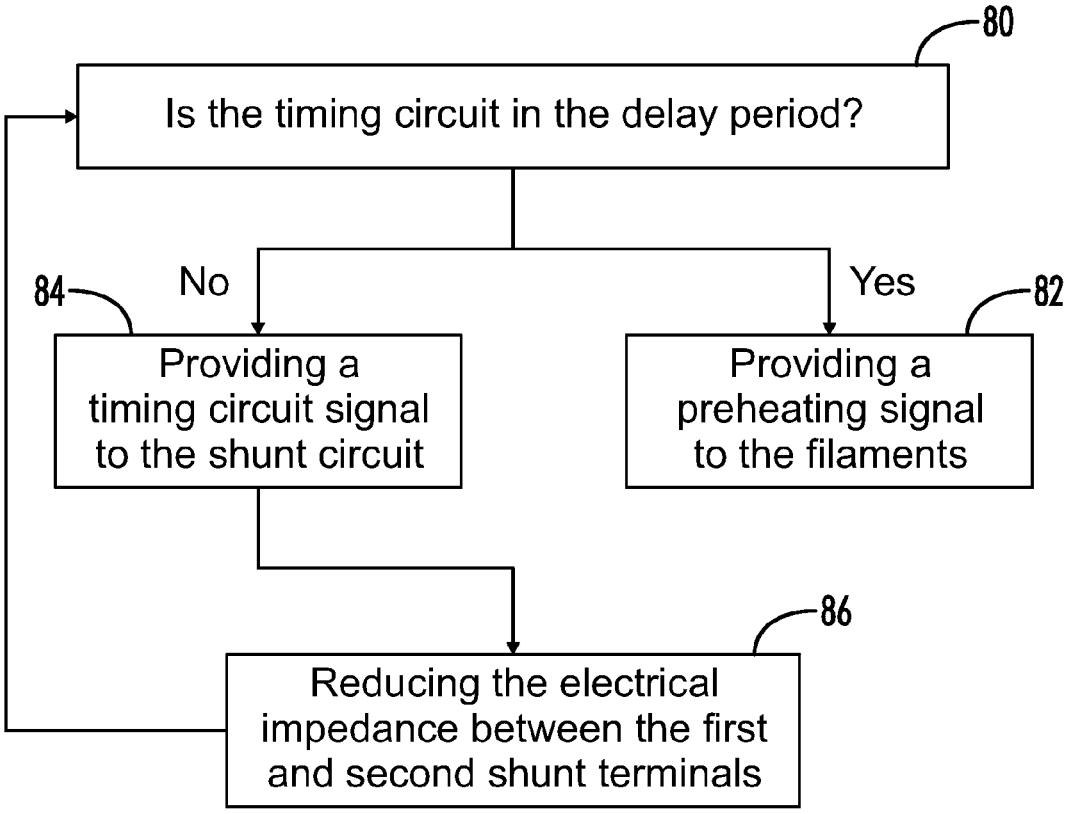
FIG. 3 is a flow diagram of the operation of one embodiment of the present invention.

Concurrently, the secondary winding 22 of the pre-heating transformer 14 will deliver a heating signal (or a pre-heating signal) to the filaments of the lamp to bring the temperature of the filaments up to a desired level prior to any attempts to strike the lamp, as shown in steps 80 and 82 of FIG. 3. After the delay period has run (corresponding to the desired filament temperature), the timing circuit 38 will provide the timing circuit signal to the switch control terminals of the first and second transistors 70, as shown in steps 80 and 84. The timing circuit signal will cause the first and second transistors 42 and 44 and the first and second diodes 46 and 52 to conduct. This creates a low impedance path between the first and second shunt terminals 32 and 34, as shown in step 86.

In other words, the first and second transistors 42 and 44 and the first and second diodes 46 and 52 create a short circuit around the primary winding 18 of the pre-heating transformer 14. Accordingly, the current, or a majority of the current, flowing through the power converter circuit 12 will flow through the newly created short circuit path—around the primary winding 16. With little or no current flowing through the primary winding 16 of the pre-heating transformer 14, the pre-heating of the filaments will cease. This allows the ballast to strike and then drive the lamps without any additional pre-heating—which is not needed during normal operation of the lamps.

Thus, although there have been described particular embodiments of the present invention of a new and useful PROGRAMMED START BALLAST FOR GAS DISCHARGE LAMPS, it is not intended that such references be construed as limitations upon the scope of this invention except as set forth in the following claims.

What is claimed is:

1. An electronic ballast for a gas discharge lamp having a filament, comprising:

a power converter circuit comprising a pre-heating transformer with a primary winding having first and second ends and a secondary winding for coupling to the filament, a resonant output transformer, a first shunt terminal coupled to the first end of the primary winding, a second shunt terminal coupled to the second end of the primary winding, and an electrical impedance defined between the first and second shunt terminals, wherein the resonant output transformer is operable to provide an output transformer signal to drive the lamp; and a bypass circuit comprising a timing circuit coupled to the resonant output transformer to receive the output transformer signal, the timing circuit having a delay period responsive to the output transformer signal and operable to generate a timing circuit signal after the delay period, the bypass circuit further comprising a shunt circuit coupled to the timing circuit to receive the timing circuit signal and further coupled between the first and second shunt terminals, wherein when the timing circuit signal is present, the shunt circuit reduces the electrical impedance between the first and second shunt terminals.

2. The ballast of claim 1 wherein when the timing circuit signal is present, the shunt circuit creates an electrical short circuit between the first and second shunt terminals.

3. The ballast of claim 1 wherein the resonant output transformer includes a secondary winding and the timing circuit is coupled to the secondary winding of the resonant output transformer.

4. The ballast of claim 3 wherein the timing circuit further comprises a resistor and a capacitor each having a component value, wherein the delay period is determined, in part, by the component values of the resistor and the capacitor.

5. The ballast of claim 1 wherein the shunt circuit comprises a first shunt switch coupled to one of the first and second shunt terminals and a second shunt switch coupled to the other of the first and second shunt terminals.

6. The ballast of claim 5 wherein the first and second shunt switches are transistors.

7. The ballast of claim 6 wherein each of the first and second shunt switches include a switch activation terminal coupled to the timing circuit to receive the timing circuit signal.

8. An electronic ballast for a gas discharge lamp having a lamp filament, comprising:

a resonant output transformer operable to generate an output transformer signal;

a timing circuit having an input coupled to the resonant output transformer to receive the output transformer signal, wherein the timing circuit is operable to generate a timing circuit signal, responsive to the output transformer signal, after a delay period;

a pre-heating circuit including a pre-heating transformer having a primary winding coupled to the resonant output transformer and a secondary winding for coupling to the filament, wherein the primary winding has a first end and a second end; and a bypass circuit having a bypass switch coupled between the first and second ends of the primary winding, the bypass circuit further coupled to the timing circuit to receive the timing circuit signal, wherein when the timing circuit signal is present, the bypass circuit, via the bypass switch, creates an electrical shunt around the primary winding.

9. The ballast of claim 8 wherein the bypass switch is a bi-directional switch.

10. The ballast of claim 8 wherein the timing circuit comprises a timing resistor and a timing capacitor and the delay period is defined, in part, by the timing resistor and the timing capacitor.

11. The ballast of claim 8 wherein the bypass switch comprises a first switching circuit coupled between the first and second ends of the primary winding and a second switching circuit coupled between the first and second ends of the primary winding.

12. The ballast of claim 11 wherein the first switching circuit comprises a first diode, with a first anode coupled to the first end of the primary winding and a first cathode, and a first transistor with a first terminal coupled to the second end of the primary winding and a second terminal coupled to the first cathode; and the second switching circuit comprises a second diode, with a second anode coupled to the second end of the primary winding and a second cathode, and a second transistor with a first terminal coupled to the first end of the primary winding and a second terminal coupled to the second cathode.

13. The ballast of 12 wherein each of the first and second transistors includes a switch control terminal coupled to the timing circuit to receive the timing circuit signal.

14. A method of operating an electronic ballast to pre-heat filaments of a gas discharge lamp, comprising:

(a) generating a timing signal after a delay period, wherein the delay period is responsive to a transformer output signal supplied by a resonant output transformer; and (b) when the timing signal is present, reducing an electrical impedance of a pre-heating circuit having a pre-heating transformer with a primary winding coupled to the resonant output transformer and a secondary winding for coupling to the filaments, wherein the electrical impedance is measured across the primary winding.

15. The method of claim 14 further comprising:

when the timing signal is not present, providing a heating signal to the secondary winding to pre-heat the filament.

16. The method of claim 14 further comprising:

charging a timing capacitor via the transformer output signal to define, in part, the delay period.

17. The method of claim 14 wherein the primary winding includes a first end and a second end, step (b) further comprising:

shunting the primary winding via a bypass circuit having a bypass switch coupled between the first and second ends of the primary winding.

18. The method of claim 17 wherein the bypass switch comprises:

a first switching circuit having a first diode, with a first anode coupled to the first end of the primary winding and a first cathode, and a first transistor with a first terminal coupled to the second end of the primary winding and a second terminal coupled to the first cathode; and a second switching circuit having a second diode, with a second anode coupled to the second end of the primary winding and a second cathode, and a second transistor with a first terminal coupled to the first end of the primary winding and a second terminal coupled to the second cathode of the diode.

19. The method of claim 18 wherein step (b) further comprises:

biasing the first transistor, the second transistor, the first diode, and the second diode to cause the first transistor, the second transistor, the first diode, and the second diode to conduct.

20. The method of claim 19 wherein each of the first and second transistors include a switch control terminal to receive the timing circuit signal.

* * * * *